United States Patent [19]

Wheeler

[11] 4,353,973

[45] Oct. 12, 1982

[54] USE OF OXALIC ACID OR AN ACID SALT THEREOF IN COLOR TRANSFER ASSEMBLAGES

[75] Inventor: Richard W. Wheeler, Pittsford, N.Y.

[73] Assignee: Eastman Kodak Company, Rochester, N.Y.

[21] Appl. No.: 278,032

[22] Filed: Jun. 29, 1981

[51] Int. Cl.[3] ..... G03C 1/40; G03C 5/54; G03C 7/00; G03C 5/24

[52] U.S. Cl. ..... 430/216; 428/411; 428/500; 428/507; 428/515; 428/520; 428/522; 428/532; 430/212; 430/215; 430/223; 430/218; 430/236; 430/237; 430/454; 430/505; 430/523; 430/531; 430/536; 524/321

[58] Field of Search ..... 430/212, 215, 216, 217, 430/218, 236, 237, 454, 523, 531, 536, 505, 223; 428/411, 500, 507, 515, 520, 522, 532; 524/321

[56] References Cited

U.S. PATENT DOCUMENTS 2,635,048 4/1953 Land ..... 430/216

OTHER PUBLICATIONS

Research Disclosure, vol. 123, Jul. 1974, Item 12331.

*Primary Examiner*—Richard L. Schilling
*Attorney, Agent, or Firm*—Harold E. Cole

[57] ABSTRACT

Photographic assemblages, elements, receiving elements and cover sheets are described employing a neutralizing layer comprising about 75 to about 150 meq. of acid/$m^2$ of element for neutralizing an alkaline processing composition. The neutralizing layer, timing layer or layer adjacent thereto also contains about 1 to about 10 meq./$m^2$ of oxalic acid, or an acid salt thereof, to minimize sensitometric changes that occur with keeping.

35 Claims, No Drawings

USE OF OXALIC ACID OR AN ACID SALT THEREOF IN COLOR TRANSFER ASSEMBLAGES

This invention relates to photography, and more particularly to photographic assemblages, elements, receiving elements and cover sheets for color diffusion transfer photography wherein a neutralizing layer is employed which comprises about 75 to about 150 meq. of acid/$m^2$ of element. The neutralizing layer, timing layer or layer adjacent thereto also contains about 1 to about 10 meq. of oxalic acid/$m^2$ of element to improve raw stock sensitometric keeping.

Various formats for color, integral transfer elements are described in the prior art, such as U.S. Pat. Nos. 3,415,644; 3,415,645; 3,415,646; 3,647,437; 3,635,707; 3,756,815, and Canadian Pat. Nos. 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

Other so-called "peel apart" formats for color diffusion transfer assemblages are described, for example, in U.S. Pat. Nos. 2,983,606; 3,362,819 and 3,362,821. In these formats, the image-receiving element is separated from the photosensitive element after development and transfer of the dyes to the image-receiving layer.

In color transfer assemblages such as those described above, a "shut-down" mechanism is needed to stop development after a predetermined time, such as 20 to 60 seconds in some formats, or up to 3 minutes or more in other formats. Since development occurs at a high pH, it is stoppd by merely lowering the pH. The use of a neutralizing layer, such as a polymeric acid, can be employed for this purpose, which will stabilize the element after the required diffusion of dyes has taken place. A timing layer is usually employed in conjunction with the neutralizing layer, so that the pH is not prematurely lowered, which would stop or restrict development. The development time is thus established by the time it takes the alkaline composition to penetrate through the timing layer. As the system starts to become stabilized, alkali is depleted throughout the structure, causing silver halide development to cease or slow down in response to this drop in pH. For each image generating unit, this shutoff mechanism establishes the amount of silver halide development and the related amount of dye formed according to the respective exposure values.

It is very important in color transfer assemblages that the sensitometric values should not change very much with time when such assemblages are stored under a variety of temperatures and humidity conditions. This is known in the art as having good "raw stock keeping". It is desirable to be able to minimize sensitometric changes that occur with keeping, yet not alter the initial sensitometric values.

In U.S. Pat. No. 2,635,048, several oxalates are disclosed as neutralizing agents for a diffusion transfer element. In *Research Disclosure,* Vol. 123, July 1974, Item 12331, it is disclosed that oxalic acid may be employed as a neutralizing material in a diffusion transfer element. A combination of a polymeric acid and oxalic acid is also disclosed. There is no teaching in either of these references, however, that a very small amount of oxalic acid or an acid salt thereof, may be employed in a neutralizing layer, timing layer or adjacent layer for a different purpose, namely to improve raw stock keeping. The amount of oxalic acid or acid salt thereof employed in my invention is much smaller than the amount that would be employed in a neutralizing layer for neutralizing the alkaline processing composition employed in the diffusion transfer process. In addition, other dicarboxalic acids suggested for use in a neutralizing layer for neutralizing alkaline processing compositions, such as malonic acid or strong acids or acid polymers such as p-toluenesulfonic acid and poly(butyl acrylate-co-2-acrylamido-3-methylpropane sulfonic acid) were found to be ineffective in minimizing sensitometric changes during raw stock keeping, as will be shown by the comparative tests hereafter. Nonacid salts of oxalic acid were also found to be ineffective.

In accordance with my invention, a photographic assemblage is provided which comprises:

(a) a photosensitive element comprising a support having thereon at least one photosensitive silver halide emulsion layer having associated therewith a dye image-providing material;

(b) a dye image-receiving layer;

(c) a neutralizing layer comprising about 75 to about 150 meq./$m^2$ of acid, other than oxalic acid, for neutralizing an alkaline processing composition; and (d) a timing layer located between the neutralizing layer and the dye image-receiving layer so that the alkaline processing composition must first permeate the timing layer before contacting the neutralizing layer; and wherein the neutralizing layer, a layer adjacent thereto, the timing layer or a layer adjacent thereto also contains about 1 to about 10 meq./$m^2$ of oxalic acid or an acid salt thereof.

Acid salts of oxalic acid useful in my invention include oxalates or tetraoxalates of ammonium, sodium, calcium, potassium or other alkali metals. Potassium tetraoxalate has been found to be especially useful. In use, the pH of the neutralizing layer is usually adjusted to about 4 to 5, however, so that the acid salt will form the oxalic acid species. As noted above, oxalic acid is employed in a concentration of about 1 to about 10 meq. of oxalic acid/$m^2$ of photosensitive element (or assemblage or receiving element or cover sheet as the case may be). This corresponds to about 0.05 to about 0.5 g/$m^2$. When an acid salt of oxalic acid is to be used, an amount equivalent to the oxalic acid concentration noted above should be employed. Especially good results have been obtained at about 0.33 g/$m^2$. Oxalic acid and its acid salts may be directly incorporable to the neutralizing layer, timing layer or adjacent layer as a 10 percent aqueous solution.

The improvement in raw stock keeping obtained by the addition of oxalic acid or an acid salt thereof to the neutralizing layer, timing layer or adjacent layers is highly surprising and was unexpected. The mechanism for minimizing sensitometric changes with keeping probably involves improving the stability of the adjacent timing layer, but the way in which this is accomplished is unknown.

In a preferred embodiment of the invention the oxalic acid or an acid salt thereof is present in the neutralizing layer. The oxalic acid, or acid salt thereof, may also be added to the timing layer, however, or a layer adjacent to either the neutralizing layer or timing layer, such as a gelatin interlayer, with equal effectiveness.

As noted above, the neutralizing layer employed in this invention comprises about 75 to 150 milliequivalents acid/$m^2$, depending upon the alkali content of the activator which is to be neutralized. Any material, other than oxalic acid, is useful as the neutralizing layer in this invention, as long as it performs the intended function. Suitable materials and their functions are disclosed on pages 22 and 23 of the July, 1974 edition of *Research Disclosure* and pages 35 through 37 of the July, 1975 edition of *Research Disclosure,* the disclosures of which are hereby incorporated by reference.

The dye image-providing material useful in this invention is either positive- or negative-working, and is either initially mobile or immobile in the photographic element during processing with an alkaline composition. Examples of initially mobile, positive-working dye image-providing materials useful in my invention are described in U.S. Pat. Nos. 2,983,606; 3,536,739; 3,705,184; 3,482,972; 2,756,142; 3,880,658 and 3,854,985. Examples of negative-working dye image-providing materials useful in my invention include conventional couplers which react with oxidized aromatic primary amino color developing agents to produce or release a dye such as those described, for example, in U.S. Pat. No. 3,227,550 and Canadian Pat. No. 602,607. In a preferred embodiment of my invention, the dye image-providing material is a ballasted, redox-dye-releasing (RDR) compound. Such compounds are well known to those skilled in the art and are, generally speaking, compounds which will react with oxidized or unoxidized developing agent or electron transfer agent to release a dye. Such nondiffusible RDR's include positive-working compounds, as described in U.S. Pat. Nos. 3,980,479; 4,139,379; 4,139,389; 4,199,354, 4,232,107, 4,199,355 and German Pat. No. 2,854,946. Such nondiffusible RDR's also include negative-working compounds, as described in U.S. Pat. Nos. 3,728,113 of Becker et al.; 3,725,062 of Anderson and Lum; 3,698,897 of Gompf and Lum; 3,628,952 of Pushel et al.; 3,443,939 and 3,443,940 of Bloom et al.; 4,053,312 of Fleckenstein; 4,076,529 of Fleckenstein et al.; 4,055,428 of Koyama et al.; 4,149,892 of Deguchi et al.; 4,198,235 and 4,179,291 of Vetter et al.; *Research Disclosure* 15157, November, 1976 and *Research Disclosure* 15654, April, 1977, the disclosures of which are hereby incorporated by reference.

In a preferred embodiment of this invention, the dye-releasers such as those in the Fleckenstein et al patent referred to above are employed. Such compounds are ballasted sulfonamido compounds which are alkali-cleavable upon oxidation to release a diffusible dye from the nucleus and have the formula:

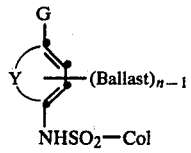

wherein:

(a) Col is a dye or dye precursor moiety;

(b) Ballast is an organic ballasting radical of such molecular size and configuration (e.g., simple organic groups or polymeric groups) as to render the compound nondiffusible in the photosensitive element during development in an alkaline processing composition;

(c) G is $OR^4$ or $NHR^5$ wherein $R^4$ is hydrogen or a hydrolyzable moiety and $R^5$ is hydrogen or a substituted or unsubstituted alkyl group of 1 to 22 carbon atoms, such as methyl, ethyl, hydroxyethyl, propyl, butyl, secondary butyl, tertiary butyl, cyclopropyl, 4-chlorobutyl, cyclobutyl, 4-nitroamyl, hexyl, cyclohexyl, octyl, decyl, octadecyl, docosyl, benzyl or phenethyl (when $R^5$ is an alkyl group of greater than 6 carbon atoms, it can serve as a partial or sole Ballast group);

(d) Y represents the atoms necessary to complete a benzene nucleus, a naphthalene nucleus or a 5- to 7-membered heterocyclic ring such as pyrazolone or pyrimidine; and (e) n is a positive integer or 1 to 2 and is 2 when G is $OR^4$ or when $R^5$ is a hydrogen or an alkyl group of less than 8 carbon atoms.

For further detail concerning the above described sulfonamido compounds and specific examples of same, reference is made to the above-mentioned Fleckenstein et al. U.S. Pat. No. 4,076,529 referred to above.

In another preferred embodiment of this invention, positive-working, nondiffusible RDR's of the type disclosed in U.S. Pat. Nos. 4,139,379 and 4,139,389 are employed. In this embodiment, an immobile compound is employed which as incorporated in a photographic element is incapable of releasing a diffusible dye. However, during photographic processing under alkaline conditions, the compound is capable of accepting at least one electron (i.e., being reduced) and thereafter releases a diffusible dye. These immobile compounds are ballasted electron accepting nucleophilic displacement compounds.

The photographic element in the above-described photographic assemblage is treated with an alkaline processing composition to effect or initiate development in any manner. One method for applying processing composition is by interjecting processing solution with communicating members similar to hypodermic syringes which are attached either to a camera or camera cartridge. The processing composition can also be applied by means of a swab or by dipping in a bath, if so desired. Another method of applying processing composition to a film assemblage which can be used in our invention is the liquid spreading means described in U.S. application Ser. No. 143,230 of Columbus, filed Apr. 24, 1980.

In a preferred embodiment of the invention, the assemblage itself contains the alkaline processing composition and means containing same for discharge within the film unit. There can be employed, for example, a rupturable container which is adapted to be positioned during processing of the film unit so that a compressive force applied to the container by pressure-applying members, such as would be found in a camera designed for in-camera processing, will effect a discharge of the container's contents within the film unit.

The dye image-receiving layer in the above-described film assemblage is optionally located on a separate support adapted to be superposed on the photographic element after exposure thereof. Such image-receiving elements are generally disclosed, for example, in U.S. Pat. No. 3,362,819. In accordance with this embodiment of the invention, the dye image-receiving element would comprise a support having thereon, in sequence, a neutralizing layer and a timing layer as described previously, and a dye image-receiving layer. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

In another embodiment, the dye image-receiving layer in the above described film assemblage is integral with the photographic element and is located between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention is employed is disclosed in Canadian Pat. No. 928,559. In this embodiment, the support for the photographic element is transparent and is coated with the image-receiving layer, a substantially opaque, light-reflective layer and the photosensitive layer or layers described above. A rupturable container, containing an alkaline processing composition and an opacifier, is positioned between the top layer and a transparent cover sheet which has thereon, in sequence, a neutralizing layer and a timing layer, as described previously. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-sensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also contains a neutralizing layer and a timing layer, as described above, underneath the dye image-receiving layer.

In another embodiment of the invention, the neutralizing layer and timing layer described above are located underneath the photosensitive layer or layers. In that embodiment, the photographic element would comprise a support having thereon, in sequence, a neutralizing layer and a timing layer, as described above, and at least one photosensitive silver halide emulsion layer having associated therewith a dye image-providing material. A dye image-receiving layer would be provided on a second support with the processing composition being applied therebetween. This format could either be integral, as described above, or peel-apart.

Another embodiment of the invention uses the image-reversing technique disclosed in British Pat. No. 904,364, page 19, lines 1 through 41. In this process, the dye-releasing compounds are used in combination with physical development nuclei in a nuclei layer contiguous to the photosensitive silver halide negative emulsion layer. The film unit contains a silver halide solvent, preferably in a rupturable container with the alkaline processing composition.

A process for producing a photographic transfer image in color according to this invention from an imagewise exposed photosensitive element comprising a support having thereon at least one photosensitive silver halide emulsion layer having associated therewith a dye image-providing material comprises treating the element with an alkaline processing composition in the presence of a silver halide developing agent to effect development of each of the exposed silver halide emulsion layers. The processing composition contacts the emulsion layer or layers prior to contacting a neutralizing layer as described above. An imagewise distribution of dye image-providing material is thus formed as a function of development, and at least a portion of it diffuses to a dye image-receiving layer to provide the transfer image. A timing layer associated with the neutralizing layer is permeated by the alkaline processing composition after a predetermined time, the timing layer being located between the neutralizing layer and the dye image-receiving layer and the photosensitive silver halide emulsion layer so that the processing composition must first permeate the timing layer before contacting the neutralizing layer. The alkaline processing composition is then neutralized by means of the neutralizing layer associated with the timing layer after the predetermined time.

The film unit or assemblage of the present invention is used to produce positive images in single or multicolors. In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith and the red-sensitive silver halide emulsion layer will have a cyan dye image-providing material associated therewith. The dye image-providing material associated with each silver halide emulsion layer is contained either in the silver halide emulsion layer itself or in a layer contiguous to the silver halide emulsion layer, i.e., the dye image-providing material can be coated in a separate layer underneath the silver halide emulsion layer with respect to the exposure direction.

The concentration of the dye image-providing material that is employed in the present invention can be varied over a wide range, depending upon the particular compound employed and the results desired. For example, the dye image-providing material coated in a layer at a concentration of 0.1 to 3 $g/m^2$ has been found to be useful. The dye image-providing material is dispersed in a hydrophilic film forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol, or 4-(N-octadecylamino)-catechol; phenylenediamine compounds, such as N,N,N',N'-tetramethyl-p-phenylenediamine. In highly preferred embodiments, the ETA is a 3-pyrazolidinone compound, such as 1-phenyl-3-pyrazolidinone (Phenidone, trademark), 1-phenyl-4,4-dimethyl-3-pyrazolidinone (Dimezone, trademark), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-xylyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, can also be employed. These ETA's are employed in the liquid processing composition or contained, at least in part, in any layer or layers of the photographic element or film unit to be activated by the alkaline processing composition, such as in the silver halide emulsion layers, the dye image-providing material layers, interlayers, image-receiving layers, etc.

In this invention, dye image-providing materials can be used which produce diffusible dye images as a function of development. Either conventional negative-working or direct-positive silver halide emulsions are employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using ballasted, redox, dye-releasers. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprises photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Any material is useful as the image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November, 1976 edition of *Research Disclosure,* the disclosure of which is hereby incorporated by reference.

Any material can be employed as the timing layer in this invention as long as it performs the intended function to time or control the pH reduction as a function of the rate at which alkali diffuses through this layer. Examples of such timing layers and their functioning are disclosed on pages 22 and 23 of the July, 1974 edition of *Research Disclosure,* and pages 35 through 37 of the July, 1975 edition of *Research Disclosure,* the disclosures of which are hereby incorporated by reference. In a preferred embodiment of my invention, the timing layer comprises a mixture of (1) from 5 to 95 percent by weight of a terpolymer comprising from 55 to 85 percent by weight of vinylidene chloride, 5 to 35 percent by weight of an ethylenically unsaturated monomer and 0 to 20 percent by weight of an ethylenically unsaturated carboxylic acid, and (2) from 5 to 95 percent by weight of a polymeric carboxy-esterlactone, as described in U.S. Pat. No. 4,229,516, of Abel, issued Oct. 21, 1980, the disclosure of which is hereby incorporated by reference.

The alkaline processing composition employed in this invention is the conventional aqueous solution of an alkaline material, e.g, alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. patent application Ser. No. 184,714, filed Sept. 8, 1980.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

*Research Disclosure* is a publication of Industrial Opportunities Ltd.; Homewell, Havant; Hampshire, P09 1EF, United Kingdom.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

(A) A control cover sheet of the type described in U.S. Pat. Nos. 4,229,516 and 4,190,447 was prepared by coating the following layers, in the order recited, on a poly(ethylene terephthalate) film support:

(1) a neutralizing layer comprising poly(n-butyl acrylate-co-acrylic acid), (30:70 weight ratio equivalent to 140 meq. acid/$m^2$);

(2) a timing layer comprising 5.4 g/$m^2$ of a 1:1 physical mixture by weight of poly(acrylonitrile-co-vinylidene chloride-co-acrylic acid latex) (weight ratio of 14/80/6) and a carboxy ester lactone formed by cyclization of a vinyl acetate-maleic anhydride copolymer in the presence of 1-butanol to produce a partial butyl ester, ratio of acid/butyl ester 15/85, containing 0.22 g/$m^2$ of t-butylhydroquinone monoacetate, and 0.16 g/$m^2$ of 1-phenyl-5-phthalimidomethylthiotetrazole;

(3) gelatin (3.8 g/$m^2$) hardened with bis(vinylsulfonyl)methyl ether (0.038 g/$m^2$); and (4) heat-sealing layer of poly(acrylonitrile-co-vinylidene chloride-co-acrylic acid) latex (0.97 g/$m^2$) at a 14:80:6 weight ratio.

(B) Another cover sheet according to the invention was prepared similar to (A), except that the neutralizing layer (1) contained 0.33 g/$m^2$ of oxalic acid.

An integral imaging-receiver element was prepared by coating the following layers in the order recited on a transparent poly(ethylene terephthalate) film support. Quantities are parenthetically given in grams per square meter, unless otherwise stated.

(1) image-receiving layer of a poly(divinylbenzene-co-styrene-co-N-benzyl-N,N-dimethyl-N-vinylbenzyl-)ammonium sulfate (1/49.5/49.5) latex mordant (2.3) and gelatin (2.3);

(2) reflecting layer of titanium dioxide (16.2) and gelatin (2.6);

(3) opaque layer of carbon black (1.9), gelatin (1.2), oxidized developer scavenger 2-(2-octadecyl)-5-sulfohydroquinone potassium salt (0.02) and cyan RDR A (0.02) dispersed in N-n-butylacetanilide, RDR/solvent ratio 1:2;

(4) cyan dye-providing layer of gelatin (0.44) and cyan RDR B (0.32) dispersed in N-n-butylacetanilide, RDR/solvent ratio 1:2;

(5) interlayer of gelatin (0.54);

(6) red-sensitive, direct-positive silver bromide emulsion (1.1 silver), gelatin (1.2), Nucleating Agent A (45 mg/Ag mole), 2-(2-octadecyl)-5-sulfohydroquinone potassium salt (0.14), Nucleating Agent B (1.6 mg/Ag mole) and titanium dioxide (0.81);

(7) interlayer of gelatin (1.2) and 2,5-di-sec-dodecylhydroquinone (1.2);

(8) magenta dye-providing layer of magenta RDR C (0.43) dispersed in diethyllauramide, RDR/solvent ratio 1:2 and gelatin (0.65);

(9) interlayer of gelatin (0.65);

(10) green-sensitive, direct-positive silver bromide emulsion (0.92 silver), gelatin (0.76), Nucleating Agent A (11.0 mg/Ag mole), Nucleating Agent C (1.2 mg/Ag mole), 2-(2-octadecyl)5-sulfohydroquinone potassium salt (0.034) and titanium dioxide (0.22);

(11) interlayer of green-sensitive, negative silver bromide emulsion (0.05 silver), gelatin (1.3) and 2,5-di-sec-do-decylhydroquinone (1.2);

(12) yellow dye-providing layer of yellow RDR D (0.32) dispersed in di-n-butyl phthalate, RDR/solvent ratio 1:2, yellow RDR E (0.24) dispersed in di-n-butyl phthalate, RDR/solvent ratio 1:2, gelatin (1.2) and hardener bis(vinylsulfonyl)methane (0.006);

(13) blue-sensitive, direct-positive silver bromide emulsion (0.92 silver), gelatin (0.91), Nucleating Agent A (31 mg/Ag mole), Nucleating Agent C (1.1 mg/Ag mole), 2-(2-octadecyl)-5-sulfohydroquinone potassium salt (0.034), t-butylhydroquinone monoacetate (0.016) and titanium dioxide (0.27); and

(14) overcoat layer of gelatin (0.89) and 2,5-di-sec-dodecylhydroquinone (0.10).

The direct-positive emulsions are approximately 0.8μ monodispersed, octahedral, internal image silver bromide emulsions, as described in U.S. Pat. No. 3,923,513.

CYAN RDR A

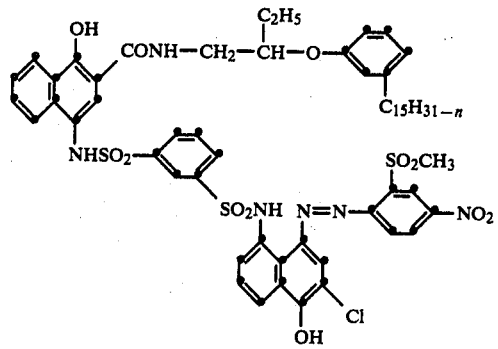

CYAN RDR B

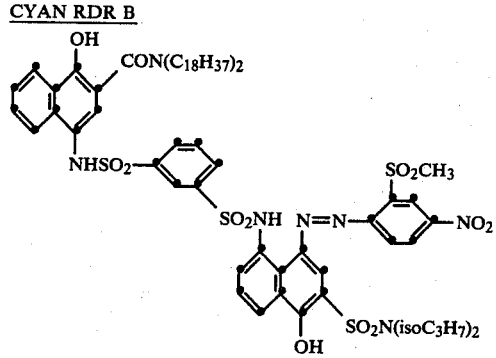

MAGENTA RDR C

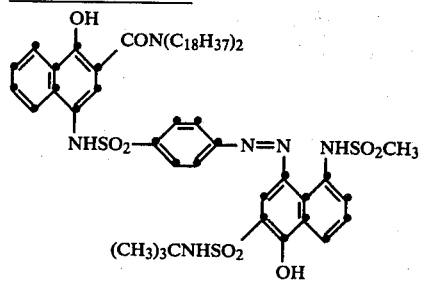

YELLOW RDR D

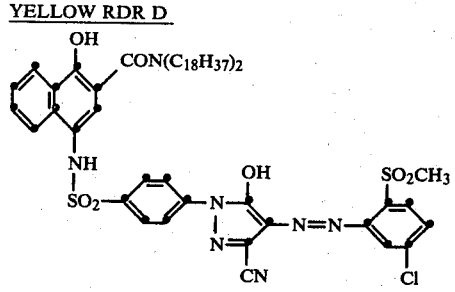

-continued

YELLOW RDR E

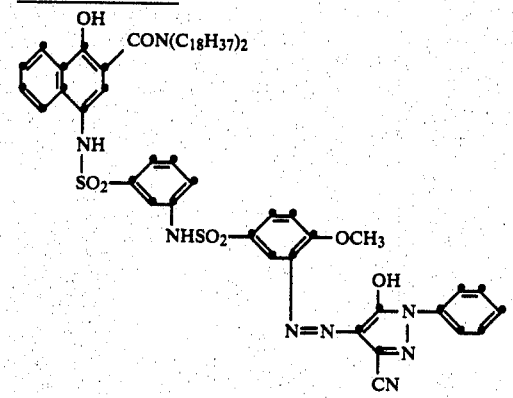

Nucleating Agent A

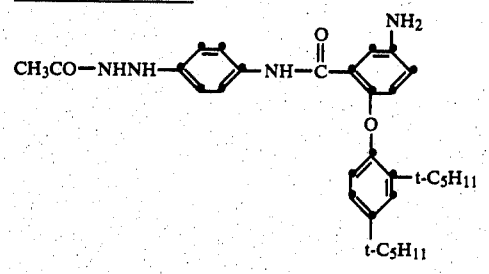

Nucleating Agent B

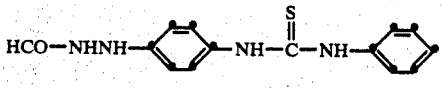

Nucleating Agent C

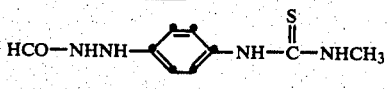

Samples of the imaging-receiver element were exposed in a sensitometer through a graduated density test object to yield a neutral at a Status A density of 1.0. The exposed samples were then processed at 21° C. by rupturing a pod containing the viscous processing composition described below between the imaging-receiver element and the cover sheets described above, by using a pair of juxtaposed rollers to provide a processing gap of about 65 μm.

The processing composition was as follows:

52.2 g potassium hydroxide
12 g 4-methyl-4-hydroxymethyl-1-p-tolyl-3-pyrazolidinone
1.5 g 1,4-cyclohexanedimethanol
4 g 5-methylbenzotriazole
1 g potassium sulfite
6.4 g Tamol SN® dispersant
10 g potassium fluoride
46 g carboxymethylcellulose
192 g carbon water to 1 liter After a period of not less than one hour, the red, green and blue Status A density of the $D_{max}$, $D_{min}$, speed and highlight scale contrast (HSC) was read. (HSC is measured as the slope of the D-log E curve between a density of 0.3 and 0.6.

$$HSC = 0.3/\log E@0.3D - \log E@0.6D.)$$

Other assembled units were incubated for 4 weeks at 37° C. at 50 percent RH before processing to evaluate sensitometric changes during keeping. The following results were obtained:

TABLE 1

| Cover Sheet | | Status A Density Fresh/Change after 4 weeks 37° C./50% RH incubation | | | |
|---|---|---|---|---|---|
| | | $D_{min}/\Delta$ | $D_{max}/\Delta$ | HSC/Δ | Speed*/Δ |
| A (Control) | Red | 0.20/+0.01 | 1.71/−0.20 | 0.88/−0.30 | 62/+07 |
| | Green | 0.20/+0.03 | 1.69/−0.04 | 0.88/−0.28 | 68/−06 |
| | Blue | 0.20/+0.03 | 1.71/+0.08 | 0.83/−0.33 | 73/−07 |
| B (With Oxalic Acid) | Red | 0.20/+0.01 | 1.68/+0.02 | 0.92/+0.01 | 66/+02 |
| | Green | 0.20/0 | 1.67/+0.04 | 0.90/−0.01 | 71/0 |
| | Blue | 0.20/0 | 1.69/−0.02 | 0.94/−0.03 | 77/+01 |

*Relative speed measured at a density of 0.7, 30 = 0.3 log E

The above results indicate that the cover sheet according to the invention shows smaller changes in red $D_{max}$, red HSC, green HSC, blue HSC and speed upon keeping. The use of oxalic acid in the cover sheet also has no noticeable effect in fresh sensitometry.

EXAMPLE 2

Samples of the integral imaging receiver element and cover sheets prepared in Example 1 were not assembled in a unit but were incubated interleaved together before use either:

(a) 4 weeks at 37° C./50% RH or (b) 2 weeks at −17° C. followed by 2 weeks at 26° C./80% RH.

The elements were then assembled and processed as in Example 1 with the following results:

TABLE 2

| Cover Sheet | | Status A Density Fresh/Change after 4 weeks 37° C./50% RH incubation | | | |
|---|---|---|---|---|---|
| | | $D_{min}/\Delta$ | $D_{max}/\Delta$ | HSC/Δ | Speed*/Δ |
| A (Control) | Red | 0.19/+0.01 | 1.92/−0.09 | 0.90/−0.20 | 61/+05 |
| | Green | 0.21/+0.02 | 1.83/+0.03 | 0.75/−0.22 | 52/−03 |
| | Blue | 0.22/+0.01 | 1.76/+0.05 | 0.75/−0.14 | 60/−03 |
| B (With Oxalic Acid) | Red | 0.19/0 | 1.89/−0.05 | 0.92/+0.03 | 61/+02 |
| | Green | 0.20/+0.01 | 1.81/−0.02 | 0.80/+0.01 | 54/+02 |
| | Blue | 0.21/0 | 1.74/+0.07 | 0.79/−0.08 | 61/+0.3 |

*Relative speed measured at a density of 0.7, 30 = 0.3 log E

TABLE 3

| Cover Sheet | | Status A Density Fresh/Change after 2 weeks −17° C.; 2 weeks 26° C./80% RH | | | |
|---|---|---|---|---|---|
| | | $D_{min}/\Delta$ | $D_{max}/\Delta$ | HSC/Δ | Speed*/Δ |
| A (Control) | Red | 0.19/+0.01 | 1.92/−0.18 | 0.90/−0.28 | 61/+11 |
| | Green | 0.21/+0.02 | 1.83/0 | 0.75/−0.26 | 52/−09 |
| | Blue | 0.22/+0.01 | 1.76/+0.07 | 0.75/−0.23 | 60/−17 |
| B (With Oxalic Acid) | Red | 0.19/0 | 1.89/−0.22 | 0.92/−0.22 | 61/+12 |
| | Green | 0.20/+0.01 | 1.81/−0.03 | 0.80/−0.17 | 54/−03 |
| | Blue | 0.21/+0.01 | 1.74/+0.08 | 0.79/−0.12 | 61/−11 |

*Relative speed measured at a density of 0.7, 30 = 0.3 log E

The above results indicate that the cover sheet according to the invention provides more stable sensitometry. The HSC and speed of all three colors are maintained much better at the lower humidity incubation when oxalic acid is present in the acid layer of the cover sheet. At the more severe high humidity incubation condition, the HSC of all three colors and the blue and green speed are maintained quite well with the cover sheet of the invention.

EXAMPLE 3

Samples of the integral imaging receiver element and cover sheets of Example 1 were processed as in Example 1. In addition, other cover sheets were prepared, similar to the control in Example 1, except that they contained other acids in the neutralizing layer as set forth in Table 4 below. All materials were added at 7.2 meq. acid/$m^2$. These cover sheets were also processed as in Example 1. Incubation of the cover sheets was for 2 weeks at 37° C./50% RH. The HSC was measured as described in Example 1 with the following results:

TABLE 4

| Cover Sheet Addendum | Status A Density Change in HSC after incubation for 2 weeks @ 37° C./50% RH | | |
|---|---|---|---|
| | Red | Green | Blue |
| None (Control) | −0.13 | −0.13 | −0.14 |
| Malonic acid (Comparison) | −0.13 | −0.15 | −0.10 |
| p-Toluenesulfonic acid (Comparison) | −0.13 | −0.12 | −0.19 |
| poly(Butyl acrylate-co-2-acrylamido-2-methyl-propanesulfonic acid (Comparison) | −0.13 | −0.15 | −0.18 |
| Dipotassium oxalate (Comparison) | −0.12 | −0.16 | −0.12 |
| Oxalic acid | −0.04 | −0.06 | −0.02 |
| Potassium tetraoxalate | −0.04 | 0 | −0.05 |

The above results indicate that oxalic acid or one of its acid salts, potassium tetraoxalate, are effective in maintaining HSC. Other acids, acid polymers, or non-acid salts of oxalic acid are shown to be ineffective for this purpose.

The invention has been described in detail with particular reference to preferred embodiments thereof, but it will be understood that variations and modifications can be effected within the spirit and scope of the invention.

What is claimed is:

1. In a photographic assemblage comprising:
(a) a photosensitive element comprising a support having thereon at least one photosensitive silver halide emulsion layer having associated therewith a dye image-providing material;
(b) a dye image-receiving layer;
(c) a neutralizing layer comprising about 75 to about 150 meq./$m^2$ of acid, other than oxalic acid, for neutralizing an alkaline processing composition; and
(d) a timing layer located between said neutralizing layer and said dye image-receiving layer so that said alkaline processing composition must first permeate said timing layer before contacting said neutralizing layer;
the improvement wherein said neutralizing layer, a layer adjacent thereto, said timing layer, or a layer adjacent thereto contains about 1 to about 10 meq./$m^2$ of oxalic acid or an acid salt thereof.

2. The assemblage of claim 1 wherein said acid salt of oxalic acid is employed.

3. The assemblage of claim 2 wherein said acid salt is potassium tetraoxalate.

4. The assemblage of claim 1 wherein said oxalic acid or acid salt thereof is present in said neutralizing layer.

5. In a photographic assemblage comprising:
(a) a photosensitive element comprising a support having thereon at least one photosensitive silver halide emulsion layer having associated therewith a dye image-providing material;
(b) a dye image-receiving layer;
(c) an alkaline processing composition and means containing same for discharge within said assemblage;
(d) a neutralizing layer comprising about 75 to about 150 meq./$m^2$ of acid, other than oxalic acid, for neutralizing said alkaline processing composition; and
(e) a timing layer located between said neutralizing layer and said dye image-receiving layer so that said alkaline processing composition must first permeate said timing layer before contacting said neutralizing layer;
the improvement wherein said neutralizing layer, a layer adjacent thereto, said timing layer, or a layer adjacent thereto contains about 1 to about 10 meq./$m^2$ of oxalic acid or an acid salt thereof.

6. The assemblage of claim 5 wherein said acid salt of oxalic acid is employed.

7. The assemblage of claim 6 wherein said acid salt is potassium tetraoxalate.

8. The assemblage of claim 5 wherein said oxalic acid or said acid salt thereof is present in said neutralizing layer.

9. The assemblage of claim 5 wherein:
(a) said dye image-receiving layer is located in said photosensitive element between said support and said silver halide emulsion layer; and
(b) said assemblage also includes a transparent cover sheet over the layer outermost from said support.

10. The assemblage of claim 9 wherein said transparent cover sheet is coated with, in sequence, said neutralizing layer and said timing layer.

11. The assemblage of claim 10 wherein said discharging means is a rupturable container containing said alkaline processing composition and an opacifying agent, said container being so positioned during processing of said assemblage that a compressive force applied to said container will effect a discharge of the container's contents between said transparent sheet and the layer outermost from said support.

12. The assemblage of claim 5 wherein said support of said photosensitive element is opaque, and said dye image-receiving layer is located on a separate transparent support superposed on the layer outermost from said opaque support.

13. The assemblage of claim 12 wherein said transparent support has thereon, in sequence, said neutralizing layer, said timing layer and said dye image-receiving layer.

14. The assemblage of claim 12 wherein said opaque support has thereon, in sequence, said neutralizing layer, said timing layer and said silver halide emulsion layer.

15. The assemblage of claim 5 wherein said dye image-providing material is a redox dye-releaser.

16. The assemblage of claim 5 wherein said dye image-providing material is a ballasted sulfonamido compound which is alkali-cleavable upon oxidation to release a diffusible color-providing moiety, said compound having the formula:

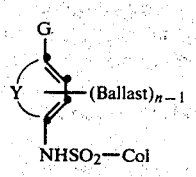

wherein:

(a) Col is a dye or dye precursor moiety;

(b) Ballast is an organic ballasting radical of such molecular size and configuration as to render said compound nondiffusible in said photosensitive element during development in an alkaline processing composition;

(c) G is $OR^4$ or $NHR^5$ wherein $R^4$ is hydrogen or a hydrolyzable moiety and $R^5$ is hydrogen or an alkyl group of 1 to 22 carbon atoms;

(d) Y represents the atoms necessary to complete a benzene nucleus, a naphthalene nucleus or a 5- to 7-membered heterocyclic ring; and (e) n is a positive integer of 1 to 2 and is 2 when G is $OR^4$ or when $R^5$ is hydrogen or an alkyl group of less than 8 carbon atoms.

17. The assemblage of claim 5 wherein said photosensitive element comprises a support having thereon a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith.

18. In an integral photographic assemblage comprising:

(a) a photosensitive element comprising a transparent support having thereon the following layers in sequence: a dye image-receiving layer; an alkaline solution-permeable, light-reflective layer; an alkaline solution-permeable, opaque layer; a red-sensitive, direct-positive silver halide emulsion layer having a ballasted redox cyan dye-releaser associated therewith; a green-sensitive, direct-positive silver halide emulsion layer having a ballasted redox magenta dye-releaser associated therewith; and a blue-sensitive, direct-positive silver halide emulsion layer having a ballasted redox yellow dye-releaser associated therewith;

(b) a transparent sheet superposed over said blue-sensitive silver halide emulsion layer and comprising a transparent support coated with, in sequence, a neutralizing layer, comprising about 75 to about 150 meq./m$^2$ of acid, other than oxalic acid, for neutralizing an alkaline processing composition, and a timing layer; and (c) a rupturable container containing said alkaline processing composition and an opacifying agent, said container being so positioned during processing of said assemblage that a compressive force applied to said container will effect a discharge of the container's contents between said timing layer and said blue-sensitive silver halide emulsion layer;

said assemblage containing a silver halide developing agent, the improvement wherein said neutralizing layer, a layer adjacent thereto, said timing layer, or a layer adjacent thereto contains about 1 to about 10 meq./m$^2$ of oxalic acid or an acid salt thereof.

19. In a process for producing a photographic transfer image in color from an imagewise exposed photosensitive element comprising a support having thereon at least one photosensitive silver halide emulsion layer having associated therewith a dye image-providing material, said process comprising treating said element with an alkaline processing composition in the presence of a silver halide developing agent to effect development of each of said exposed silver halide emulsion layers, said processing composition contacting said emulsion layer prior to contacting a neutralizing layer comprising about 75 to about 150 meq./m$^2$ of acid, other than oxalic acid, for neutralizing said alkaline processing composition, whereby an imagewise distribution of dye image-providing material is formed as a function of development and at least a portion of it diffuses to a dye image-receiving layer to provide said transfer image, a timing layer associated with said neutralizing layer being permeated by said alkaline processing composition after a predetermined time, said timing layer being located between said neutralizing layer and said dye image-receiving layer so that said alkaline processing composition must first permeate said timing layer before contacting said neutralizing layer, whereby said alkaline processing composition is neutralized by means of said neutralizing layer associated with said timing layer after said predetermined time;

the improvement wherein said neutralizing layer, a layer adjacent thereto, said timing layer, or a layer adjacent thereto contains about 1 to about 10 meq./m$^2$ of oxalic acid or an acid salt thereof.

20. The process of claim 19 wherein said acid salt of oxalic acid is employed.

21. The process of claim 20 wherein said acid salt is potassium tetraoxalate.

22. The process of claim 19 wherein said oxalic acid or acid salt thereof is present in said neutralizing layer.

23. In a dye image-receiving element adapted to be permeated by an alkaline processing composition comprising a support having thereon, in sequence, a neutralizing layer comprising about 75 to about 150 meq./m$^2$ of acid, other than oxalic acid, for neutralizing said alkaline processing composition, a timing layer and a dye image-receiving layer, the improvement wherein said neutralizing layer, a layer adjacent thereto, said timing layer or a layer adjacent thereto contains about 1 to about 10 meq./m$^2$ of oxalic acid or an acid salt thereof.

24. The element of claim 23 wherein said acid salt of oxalic acid is employed.

25. The element of claim 24 wherein said acid salt is potassium tetraoxalate.

26. The element of claim 23 wherein said oxalic acid or acid salt thereof is present in said neutralizing layer.

27. In a cover sheet adapted to be permeated by an alkaline processing composition, comprising a transparent support having thereon, in sequence, a neutralizing layer comprising about 75 to about 150 meq./m$^2$ of acid, other than oxalic acid, for neutralizing said alkaline processing composition and a timing layer, the improvement wherein said neutralizing layer, a layer adjacent thereto, said timing layer or a layer adjacent thereto contains about 1 to about 10 meq./m$^2$ of oxalic acid or an acid salt thereof.

28. The cover sheet of claim 27 wherein said acid salt of oxalic acid is employed.

29. The cover sheet of claim 28 wherein said acid salt is potassium tetraoxalate.

30. The cover sheet of claim 27 wherein said oxalic acid or acid salt thereof is present in said neutralizing layer.

31. In a photographic element adapted to be permeated by an alkaline processing composition comprising a support having thereon, in sequence, a neutralizing layer comprising about 75 to about 150 meq./$m^2$ of acid, other than oxalic acid, for neutralizing said alkaline processing composition, a timing layer, and at least one photosensitive silver halide emulsion layer having associated therewith a dye image-providing material, the improvement wherein said neutralizing layer, a layer adjacent thereto, said timing layer or a layer adjacent thereto contains about 1 to about 10 meq./$m^2$ of oxalic acid or an acid salt thereof.

32. The element of claim 31 wherein said acid salt of oxalic acid is employed.

33. The element of claim 32 wherein said acid salt is potassium tetraoxalate.

34. The element of claim 31 wherein said oxalic acid or acid salt thereof is present in said neutralizing layer.

35. The element of claim 31 which comprises a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith.

* * * * *